US008636535B1

(12) United States Patent
Gattuso

(10) Patent No.: US 8,636,535 B1
(45) Date of Patent: Jan. 28, 2014

(54) ELECTRICAL CONNECTOR HAVING METALLIC SHIELDS TO AVOID EMI FOR CPU

(75) Inventor: Andrew David Gattuso, Chandler, AZ (US)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 8 days.

(21) Appl. No.: 13/547,030

(22) Filed: Jul. 11, 2012

(51) Int. Cl.
*H01R 13/625* (2006.01)

(52) U.S. Cl.
USPC ..... 439/342

(58) Field of Classification Search
USPC ..... 439/342, 259
See application file for complete search history.

(56) References Cited

U.S. PATENT DOCUMENTS 4,433,886 A * 2/1984 Cassarly et al. ..... 439/65
4,511,201 A * 4/1985 Baker et al. ..... 439/260
4,742,385 A * 5/1988 Kohmoto ..... 257/697
5,241,453 A * 8/1993 Bright et al. ..... 361/704
5,357,404 A * 10/1994 Bright et al. ..... 361/818
6,340,309 B1 1/2002 Lin et al.
6,533,613 B1 * 3/2003 Turner et al. ..... 439/607.05
6,666,703 B2 * 12/2003 Takeuchi ..... 439/342
8,337,232 B2 * 12/2012 Chang ..... 439/342
2012/0045908 A1 2/2012 Chang

* cited by examiner

*Primary Examiner* — Neil Abrams
(74) *Attorney, Agent, or Firm* — Wei Te Chung; Ming Chieh Chang

(57) ABSTRACT

An electrical connector for electrically connecting a central processing unit (CPU) to a printed circuit board (PCB) includes a base having a first opening and a plurality of passageways with a plurality of contacts therein. A base shield is assembled on the first opening of the base. A cover is mounted upon the base and has a second opening corresponding to the first opening of the base and a plurality of through holes corresponding to the passageways. A cover shield is assembled on the second opening of the cover for contacting with the CPU and the base shield. An actuator driving the cover with the cover shield slides along the base with the base shield in a front-to-back direction.

20 Claims, 4 Drawing Sheets

ELECTRICAL CONNECTOR HAVING METALLIC SHIELDS TO AVOID EMI FOR CPU

BACKGROUND OF THE INVENTION

1. Field of the Invention

The present invention relates to an electrical connector for electrically connecting a central processing unit (CPU) to a printed circuit board (PCB), more particularly relates to an electrical connector incorporated with metallic shields to avoid electromagnetic interference (EMI) for the CPU.

2. Description of Related Art

A conventional electrical connector for electrically connecting a central processing unit (CPU) with a plurality of conductive pins to a printed circuit board (PCB) disclosed in U.S. Pat. No. 6,340,309 which is issued to Lin et al. on Jan. 22, 2002 comprises a base having a plurality of terminals received therein, a cover mounted on the base and a driving member driving the cover sliding along the base. The base defines a first opening located at a middle position thereof and a plurality of passageways disposed around the first opening for receiving the terminals. The cover has a second opening corresponding to the first opening of the base and a plurality of through holes for the conductive pins of the CPU passing through. A hollow area is formed by the first and second openings. The electrical connector establishes electrical connection between the CPU and the PCB through the terminals contacting with the conductive pins of the CPU and the terminals being soldered to PCB.

As high-speed input/output and miniaturization requirements, the CPU is required to increase a plurality of electronic components disposed thereunder. The electronic components are received to the hollow area of the electrical connector when the CPU is assembled to the electrical connector. However, electrical signals occurred within the electronic components can produce electromagnetic interference (EMI) affecting electronic signal transmission of the terminals of the electrical connector.

To solve the problem that above mentioned, U.S. publication No. 2012/0045908A1 published to Chang (hereinafter "Chang") on Feb. 23, 2012 discloses an electrical connector for electrically connecting a CPU with a plurality of electronic components assembled thereunder and conductive pins surrounding the electronic components to a PCB. The electrical connecter comprises a base having a plurality of terminals received therein for contacting with the conductive pins of the CPU, a cover mounted on the base, an actuator actuating the cover sliding along the base and a shielding frame mounted on the base. The base has a first opening and a plurality of passageways surrounding the first opening for receiving the terminals. The cover has a second opening corresponding to the first opening. The shielding frame is tightly attached to the sidewalls of the first opening and received in the first and second openings to prevent terminals from EMI emitted from electronic components assembled under the CPU.

As Chang discloses the single shielding frame tightly attached to the base, so when the cover moves relative to the base while the cover will move relative to the single shielding frame. When the CPU is mounted on the cover and moved with the cover, the CPU will move relatively to the shielding frame. Thus, a rigidity friction will generate between the CPU and the shielding frame that will damage the CPU.

Hence, it is desirable to provide an improved electrical connector to overcome the aforementioned disadvantages.

SUMMARY OF THE INVENTION

Accordingly, an object of the present invention is to provide an electrical connector with metallic shields to shroud EMI emitted from electronic components mounted under CPU.

According to one aspect of the present invention, there is provided an electrical connector for electrically connecting a central processing unit (CPU) to a printed circuit board (PCB) comprises a base having a first opening and a plurality of passageways with a plurality of contacts therein. A base shield is assembled on the first opening of the base. A cover is mounted upon the base and has a second opening corresponding to the first opening of the base and a plurality of through holes corresponding to the passageways. A cover shield is assembled on the second opening of the cover for contacting with the CPU and the base shield. An actuator driving the cover with the cover shield slides along the base with the base shield in a front-to-back direction.

According to another aspect of the present invention, there is provided an electrical connector comprises a base having a plurality of passageways receiving contacts. A base shield is assembled to the base and having a sidewall. A cover is mounted upon the base and has a plurality of through holes corresponding to the passageways. A cover shield is assembled to the cover and has a cantilever beam contacting with the base shield. An actuator driving the cover moves along the base so that the cantilever beam of the cover shield engages with the sidewall of the base shield in a front-to-back direction.

Other objects, advantages and novel features of the invention will become more apparent from the following detailed description of a preferred embodiment when taken in conjunction with the accompanying drawings.

DETAILED DESCRIPTION OF THE INVENTION

Reference will now be made to the drawings to describe the present invention in detail.

Figure 1:
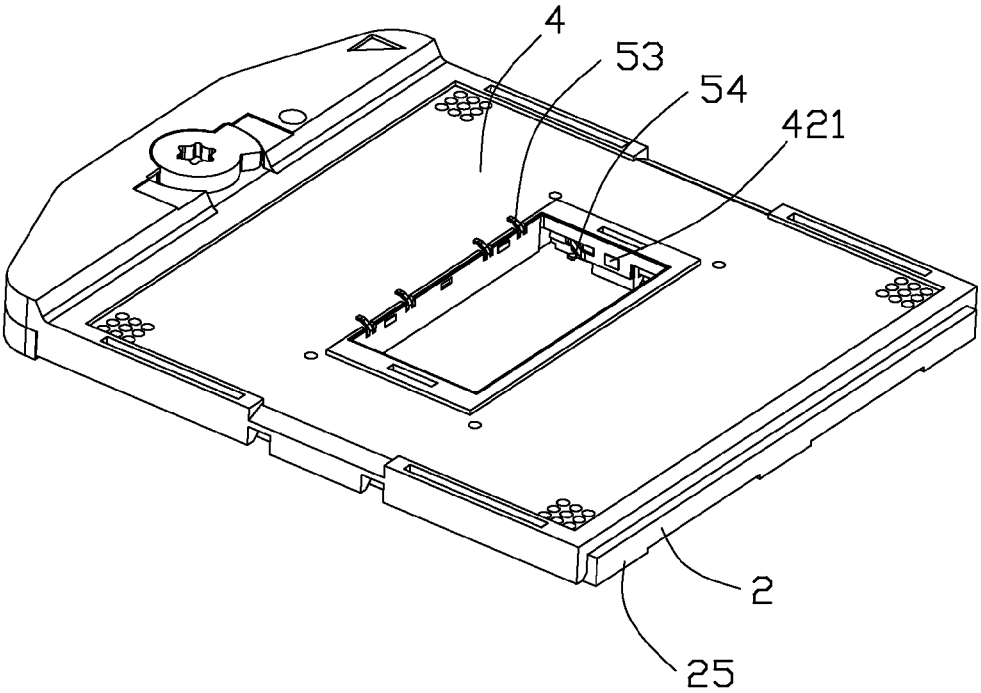
FIG. 1 is an assembled, perspective view of an electrical connector in accordance with the present invention.
Figure 2:
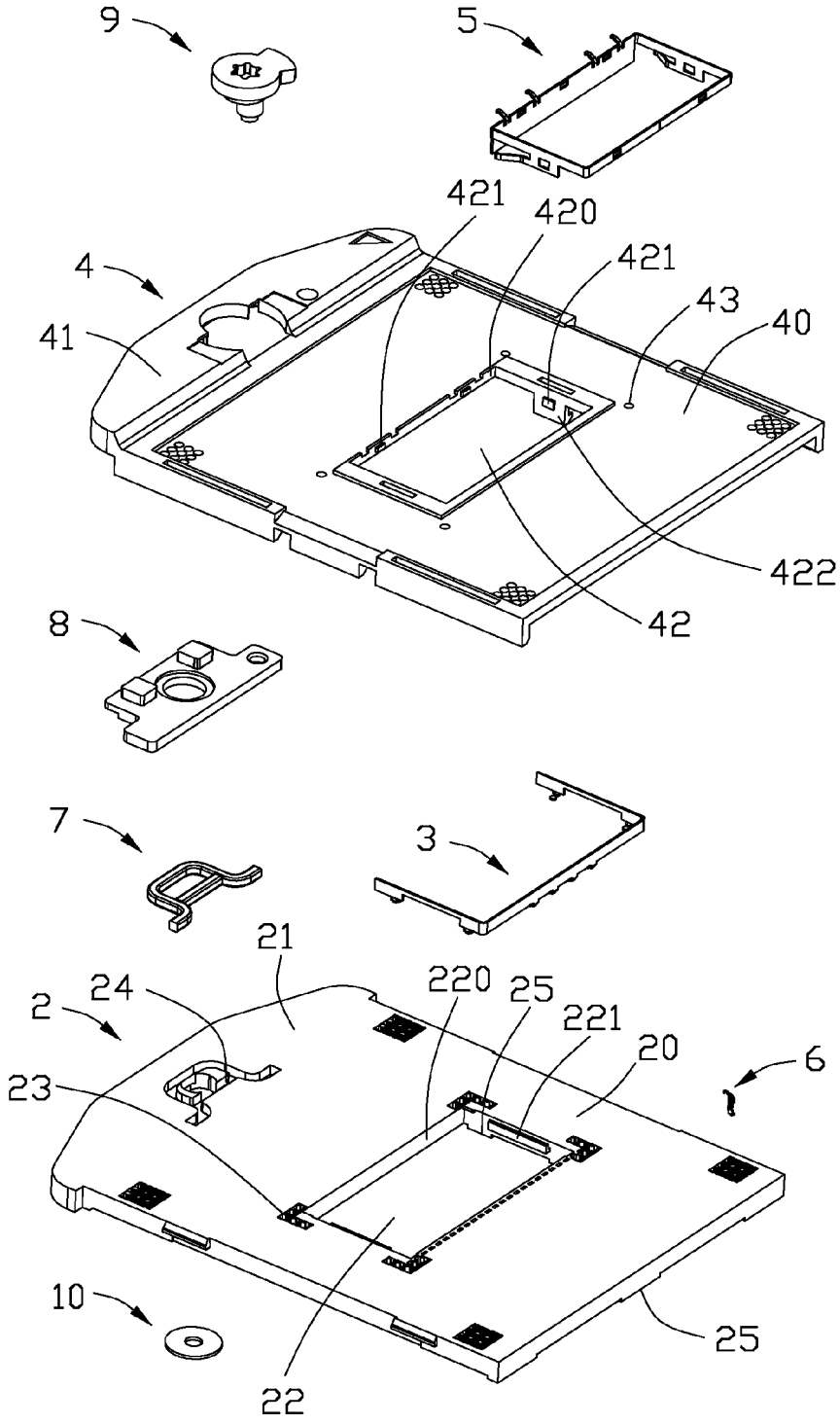
FIG. 2 is an exploded, perspective view of the electrical connector shown in FIG. 1.

FIGS. 1-2 illustrate an electrical connector of the present invention for electrically connecting a CPU (central processing unit) to a PCB (printed circuit board). Pertinent CPU in which the present invention can be applied is typically disclosed in US publication No. 2012/0045908A1 which is herein incorporated for reference. The electrical connector comprises an insulative base 2 with a base shield 3 and a cover 4 with a cover shield 5. The cover 4 and the cover shield 5 can be moved along the base 1 and the base shield 3 in a front-to-back direction by driving an actuator 9.

Figure 3:
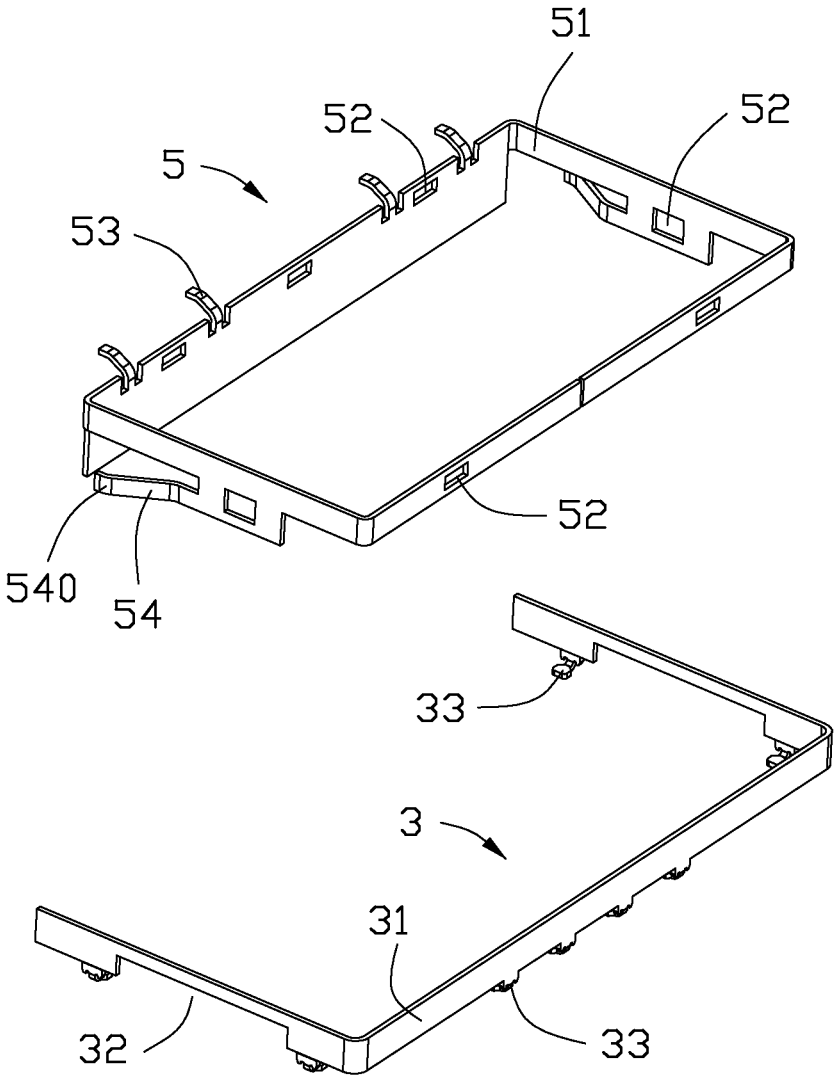
FIG. 3 is an exploded view of a cover shield and a base shield of the electrical connector shown in FIG. 2.
Figure 4:
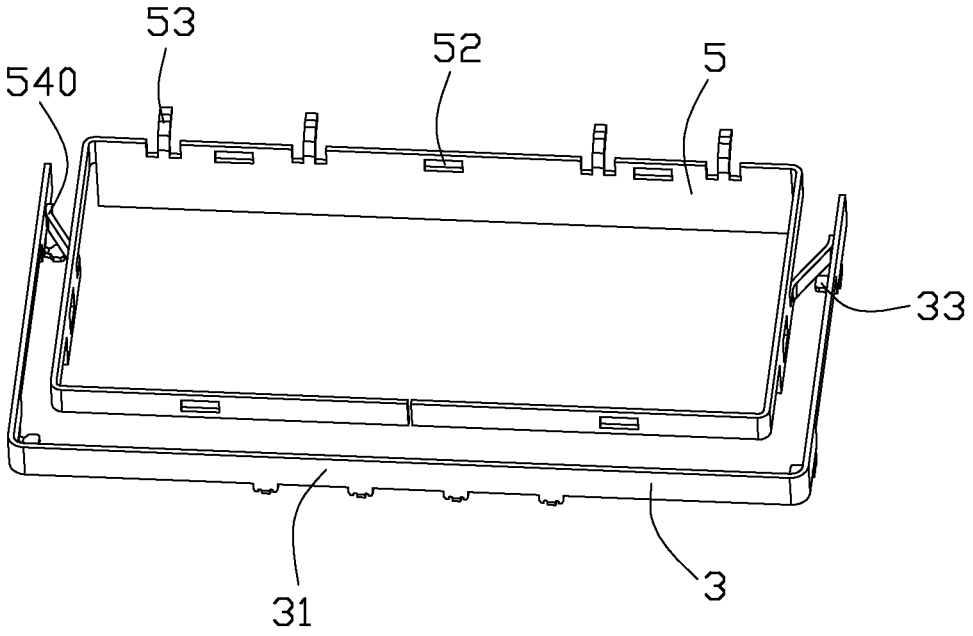
FIG. 4 is an assembled, perspective view of the cover shield and a base shield of the electrical connector shown in FIG. 3.

Referring to FIGS. 3 and 4, the base 2 has a main portion 20 with a plurality contacts 6 received thereof and a first head portion 21 extending from one end of the main portion 20. The main portion 20 defines a first opening 22 positioned at a center area thereof and a plurality of passageways 23 with contacts 6 surrounding the first opening 22. The first opening 22 is substantially formed with a rectangular shape with four sidewalls 220 and two opposite sidewalls 220 each has a hook 221 to engage with the base shield 3. The hook 221 is configured with an L-shape which extends horizontally from the sidewall 220 and then bends upwardly. A plurality of standoffs 25 are defined on a bottom surface of the base 2 to keep the bottom surface of the base 2 and the PCB have a definite distance for preventing solder balls (not shown) from excessive melting. The first head portion 21 defines a first recess 24 to receive a base plate 7.

The cover 4 includes a supporting portion 40 corresponding to the main portion 20 of the base 2 and a second head portion 41 corresponding to the first head portion 21 of the base 2. The supporting portion 40 defines a second opening 42 corresponding to the first opening 22 and in communicate with the first opening 22. The supporting portion 40 further includes a plurality of through holes 43 corresponding to the passageways 23 for allowing pins (not shown) of CPU (not shown) to pass through. The second opening 42 has four sidewalls 420 and each sidewall 420 has at least one block 421 protruding outwardly for engaging with the cover shield 5. A pair of latches 422 extend downwardly from two opposite sidewalls 420 of the cover 4 to latch the bottom surface of the base 2 and can move along the bottom surface in the front-to-back direction. The second head portion 41 has a cover plate 8 disposed at bottom thereof. The cover plate 8 and the base plate 7 assembled in the cover 4 and base 2, respectively, to allow the actuator 9 passing through and a washer 10 disposed at the bottom surface of the base 2 and riveting the actuator 9.

Referring to FIGS. 3 to 4, the base shield 3 is made of metallic plate and includes three sidewalls 31 formed with a substantially U-shape. Two opposite the sidewalls 31 each defines a notch 32 engaging with the hook 221 of the base 2. A plurality of butt joints 33 are extending downwardly from the bottom of the sidewalls 31 and then bent horizontally to be soldered on ground of the PCB.

The cover shield 5 is made of metallic plate and formed with a rectangular shape with four sidewalls 51 smaller than the base shield 3 so as to essentially positioned in the base shield 3. Each sidewall 51 of the cover shield 5 defines at least one cut out window 52 to snap onto the corresponding block 421 of the cover 4 to fix the cover shield 5 on the second opening 42 of the cover 4. Referring to FIG. 1, a plurality of spring arms 53 extending upwardly from the sidewalls 51 and outwardly from the second opening 42 of the cover 4 for connecting with the CPU. A pair of cantilever beams 54 extend horizontally from two opposite sidewalls 51 of the cover shield 5 and each bent outwardly to form a mating portion 540 at free end thereof. Each mating portion 540 of the cover shield 5 engages with and moves along the corresponding sidewalls 31 of the base shield 3 as the cover 4 moves along the base 2. One sidewall 51 of the cover shield 5 has a large height only to watch open side of the base shield 3.

In the present invention, the base shield 3 is assembled in the first opening 22 of the base 2 and the cover shield 5 is fixed in the second opening of the cover 4. When the electrical connector is assembled, the cover shield 5 disposes inside of the base shield 3. Furthermore, when the CPU is mounted upon the cover 4, the cover 4, the CPU, and the cover shield 5 are commonly moved along the base 2 and the base shield 3 while the spring arms 53 of the cover shield 5 always contact with the CPU. In the instant invention, a friction is generated between the cover shield 5 and the base shield 3 rather the CPU and the cover shield 5 so as to protect the CPU.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector for electrically connecting a central processing unit (CPU) to a printed circuit board (PCB), comprising:

a base having a first opening with sidewalls and a plurality of passageways with a plurality of contacts therein;

a base shield assembled on the first opening of the base;

a cover mounted upon the base and having a second opening with sidewalls corresponding to the first opening of the base and a plurality of through holes corresponding to the passageways;

a cover shield assembled on the second opening of the cover for contacting with the CPU and the base shield; and an actuator driving the cover with the cover shield sliding along the base with the base shield in a front-to-back direction.

2. The electrical connector as claimed in claim 1, wherein the cover shield comprises a plurality of spring arms extending upwardly and beyond the second opening of the cover.

3. The electrical connector as claimed in claim 1, wherein the cover shield comprises a cantilever beam extending outwardly to contact with the base shield.

4. The electrical connector as claimed in claim 1, wherein the cover shield defines a plurality of cut out windows and the sidewalls of second opening comprise a plurality of blocks to match with the cut out windows.

5. The electrical connector as claimed in claim 1, wherein a pair of latches extend downwardly from the sidewalls of the second opening of the cover to latch the bottom of the base.

6. The electrical connector as claimed in claim 1, wherein the base shield comprises a plurality of butt joints extending downwardly for connecting with the PCB.

7. The electrical connector as claimed in claim 1, wherein the base comprises a plurality of standoffs to support the electrical connector.

8. The electrical connector as claimed in claim 1, wherein at least one sidewall of the first opening comprises a hook to latch the base shield.

9. The electrical connector as claimed in claim 8, wherein the hook extends horizontally from the sidewall of the first opening and then bends upwardly.

10. An electrical connector, comprising:

a base having a plurality of passageways receiving contacts;

a base shield assembled to the base and having a sidewall;

a cover mounted upon the base and having a plurality of through holes corresponding to the passageways;

a cover shield assembled to the cover and having a cantilever beam contacting with the base shield; and an actuator driving the cover moving along the base so that the cantilever beam of the cover shield engages with the sidewall of the base shield in a front-to-back direction.

11. The electrical connector as claimed in claim 10, wherein the cover shield comprises a plurality of spring arms extending beyond the surface of the cover.

12. The electrical connector as claimed in claim 10, wherein the base shield comprises a plurality of butt joints extending downwardly from the sidewalls thereof.

13. The electrical connector as claimed in claim 10, wherein the cover comprises a second opening with sidewalls surrounded by the through holes and the sidewalls of the cover comprise at least one block to snap to a cut out window of the cover shield.

14. The electrical connector as claimed in claim 10, wherein the base comprises a first opening with sidewalls surrounded by the passageways and the sidewalls of the base comprise at least one hook to latch the sidewall of the base shield.

15. The electrical connector as claimed in claim 10, wherein the cover shield is smaller than the base shield so that the cover shield is essentially positioned in the base shield.

16. An electrical connector for mounting to a printed circuit board and use with an electronic package having downward pins thereof, comprising:

an insulative base defining a contact area with a lower center through opening therein, and a head portion in front of said contact area;

a plurality of passageways defines in the contact area for receiving the corresponding pins, respectively;

a plurality of contacts disposed in the corresponding passageways for contacting the corresponding pins, respectively;

an insulative cover, for upward confrontation with the electronic package, back and forth moveably assembled unto the base and defining a pin receiving region with an upper center through opening, and a head section in front of said pin receiving region;

a plurality of through holes defined in the pin receiving region and essentially vertical aligned with the corresponding passageways, respectively, for passage of the corresponding pins;

an actuation mechanism located in the head portion and the head section to actuate the cover to move relative to the base; and an upper metallic shield assembled to the cover, and a lower metallic shield assembled to the base in a coupled manner with the upper shield; wherein the upper shield and the lower shield cooperates with each other to laterally shield a common center through hole which is formed by the upper center through hole and the lower center through hole under condition that the upper shield further includes an upper contacting section for electrically and mechanically connecting to the CPU while the lower shield further includes a lower contacting section for electrically and mechanically connecting to the printed circuit board.

17. The electrical connector as claimed in claim 16, wherein at least one of the upper shield and the lower shield includes a spring finger to contact the other.

18. The electrical connector as claimed in claim 16, wherein the common through hole is rectangular, and at least one of said upper shield and said lower shield covers four sides of the common through hole.

19. The electrical connector as claimed in claim 16, wherein the upper shield includes a portion to cooperate with the base for laterally sandwiching the lower shield therebetween.

20. The electrical connector as claimed in claim 16, wherein said base and said cover are configured to allow the corresponding upper shield and the lower shield to be downwardly assembled thereto.

* * * * *